US010301900B2

(12) United States Patent
Boulanger

(10) Patent No.: US 10,301,900 B2
(45) Date of Patent: May 28, 2019

(54) SYSTEMS AND METHODS FOR ASSEMBLING A BLOWOUT PREVENTER

(71) Applicant: CAMERON INTERNATIONAL CORPORATION, Houston, TX (US)

(72) Inventor: Bruce A. Boulanger, Houston, TX (US)

(73) Assignee: Cameron International Corporation, Houston, TX (US)

( * ) Notice: Subject to any disclaimer, the term of this patent is extended or adjusted under 35 U.S.C. 154(b) by 405 days.

(21) Appl. No.: 15/009,426

(22) Filed: Jan. 28, 2016

(65) Prior Publication Data

US 2017/0218716 A1 Aug. 3, 2017

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS 2,712,458 A * 7/1955 Lipson ..... F16L 17/06 138/44
2012/0318387 A1* 12/2012 Chen ..... F16L 29/00 137/614
2014/0262313 A1* 9/2014 Gilmore ..... E21B 33/085 166/363

* cited by examiner

*Primary Examiner* — Moshe Wilensky
(74) *Attorney, Agent, or Firm* — Helene Raybaud

(57) ABSTRACT

An assembly tool for assembling a blowout preventer including a hub configured for releasably coupling with a hydraulic package of the blowout preventer, a support ring coupled to the hub, wherein the support ring is configured for releasably coupling with an outer housing of the blowout preventer, and a first seating assembly coupled to the hub, wherein the first seating assembly is configured to apply a force against the hydraulic package to seat the hydraulic package within the outer housing, and react the force applied to the hydraulic package against the outer housing.

13 Claims, 8 Drawing Sheets

SYSTEMS AND METHODS FOR ASSEMBLING A BLOWOUT PREVENTER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling systems use drilling fluid or mud for drilling a wellbore in a subterranean earthen formation. In some applications, drilling systems include a blowout preventer (BOP) configured to control the inlet and outlet of fluid from the wellbore, and particularly, to confine well fluid in the wellbore in response to a "kick" or rapid influx of formation fluid into the wellbore. An individual BOP stack may include both ram BOPs and annular BOPs. Annular BOPs are configured to close or seal against the outer surface of a drill string extending through the BOP stack.

In some applications, annular BOPs include a hydraulic assembly or package for actuating between an open position allowing for fluid flow in an annulus disposed between the drill string and the annular BOP, and a closed position restricting fluid flow through the annulus. The hydraulic package may include one or more seals for sealing against an outer housing of the annular BOP, where engagement from the outer housing compresses the one or more seals to provide a sealing engagement therebetween. In some applications, engagement between the one or more seals of the hydraulic package and the outer housing increases the difficulty of inserting the hydraulic package into, and removing it from, the outer housing. Particularly, sealing engagement provided by the one or more seals may necessitate using a relatively large amount of force to properly seat the hydraulic package within the outer housing when installing the hydraulic package therewithin.

SUMMARY

An embodiment of an assembly tool for assembling a blowout preventer comprises a hub configured for releasably coupling with a hydraulic package of the blowout preventer, a support ring coupled to the hub, wherein the support ring is configured for releasably coupling with an outer housing of the blowout preventer, and a first seating assembly coupled to the hub, wherein the first seating assembly is configured to apply a force against the hydraulic package to seat the hydraulic package within the outer housing, and react the force applied to the hydraulic package against the outer housing. In some embodiments, the first seating assembly comprises inner fastener threadably engaging a displacement sleeve disposed about the inner fastener, and wherein the inner fastener is configured to releasably couple with the hydraulic package. In some embodiments, the inner fastener is coupled to the hydraulic package and the support ring is coupled to the outer housing, rotation of the displacement sleeve causes the inner fastener to be displaced through the displacement sleeve and seat the hydraulic package within the outer housing. In certain embodiments, the force applied against the hydraulic package reacts against a frictional force applied to the hydraulic package from the outer housing. In certain embodiments, the assembly tool further comprises a pin inserted through an aperture radially extending through the outer housing and an aperture radially extending through the support ring to releasably couple the support ring to the outer housing. In some embodiments, the assembly tool further comprises a second seating assembly coupled to the hub, wherein the second seating assembly comprises an inner fastener threadably engaging a displacement sleeve disposed about the inner fastener, and wherein the inner fastener is configured to releasably couple with a piston of the hydraulic package for seating an upper end of the piston against a lower surface of the hub.

An embodiment of an assembly tool for assembling a blowout preventer comprises a hub configured for releasably coupling with a hydraulic package of the blowout preventer, a support ring coupled to the hub, wherein the support ring is configured for releasably coupling with an outer housing of the blowout preventer, and a first seating assembly coupled to the hub, wherein the first seating assembly comprises an inner fastener threadably engaging a displacement sleeve disposed about the inner fastener, and wherein the inner fastener is configured to releasably couple with the hydraulic package, wherein, when the inner fastener is coupled to the hydraulic package and the support ring is coupled to the outer housing, rotation of the displacement sleeve causes the inner fastener to be displaced through the displacement sleeve and seat the hydraulic package within the outer housing. In some embodiments, the first seating assembly is configured to apply a force against the hydraulic package to seat the hydraulic package within the outer housing, and react the force applied to the hydraulic package against the outer housing. In some embodiments, the assembly tool further comprises a coupling assembly coupled to the support ring for releasably coupling the support ring to the outer housing, wherein the coupling assembly is actuatable between a radially inner position unlocked from the outer housing and a radially outer position locked to the outer housing via engagement between engagement members of the coupling assembly and corresponding engagement members of the outer housing. In certain embodiments, the coupling assembly comprises a locking dog comprising the engagement members for engaging the engagement members of the outer housing, and a locking rod threadably engaging the support ring configured for actuating the locking dog between an unlocked position and a locked position. In certain embodiments, the hub comprises a pocket extending into a radially outer surface of the hub. In some embodiments, the assembly tool further comprises a second seating assembly coupled to the hub, wherein the second seating assembly comprises an inner fastener threadably engaging a displacement sleeve disposed about the inner fastener, and wherein the inner fastener is configured to releasably couple with a piston of the hydraulic package for seating an upper end of the piston against a lower surface of the hub.

An embodiment of a method for assembling a blowout preventer comprises coupling a hydraulic package of the blowout preventer to a hub of an assembly tool, seating an upper end of a piston of the hydraulic package against a lower surface of the hub by rotating a first seating assembly of the assembly tool, and seating the hydraulic package against a seat within an outer housing of the blowout preventer by rotating a second seating assembly of the assembly tool. In some embodiments, the method further comprises lowering the assembly tool and hydraulic package coupled thereto into a throughbore of the outer housing using a flexible member coupled to the hub. In some embodiments, the method further comprises applying a force against the hydraulic package to seat the hydraulic package within the outer housing and reacting the force applied to the hydraulic package against the outer housing. In certain embodiments, the method further comprises reacting the force against the outer housing using a coupling assembly releasably coupled to the outer housing. In certain embodiments, the method further comprises longitudinally aligning a piston of the hydraulic package with an inner cylinder and an outer cylinder of the hydraulic package by rotating a displacement sleeve of a seating assembly coupled to the hub. In some embodiments, the method further comprises rotating a displacement sleeve threadably engaging an inner fastener to displace the hydraulic package through a throughbore of the outer housing to seat the hydraulic package within the outer housing. In some embodiments, rotating the displacement sleeve applies a force against the hydraulic package and reacts the force applied against the hydraulic package against the outer housing. In certain embodiments, the method further comprises actuating a coupling assembly coupled to the hub between a radially inner position unlocked from the outer housing and a radially outer position locked to the outer housing.

BRIEF DESCRIPTION OF THE DRAWINGS

For a detailed description of exemplary embodiments, reference will now be made to the accompanying drawings in which.

DETAILED DESCRIPTION

Figure 1:
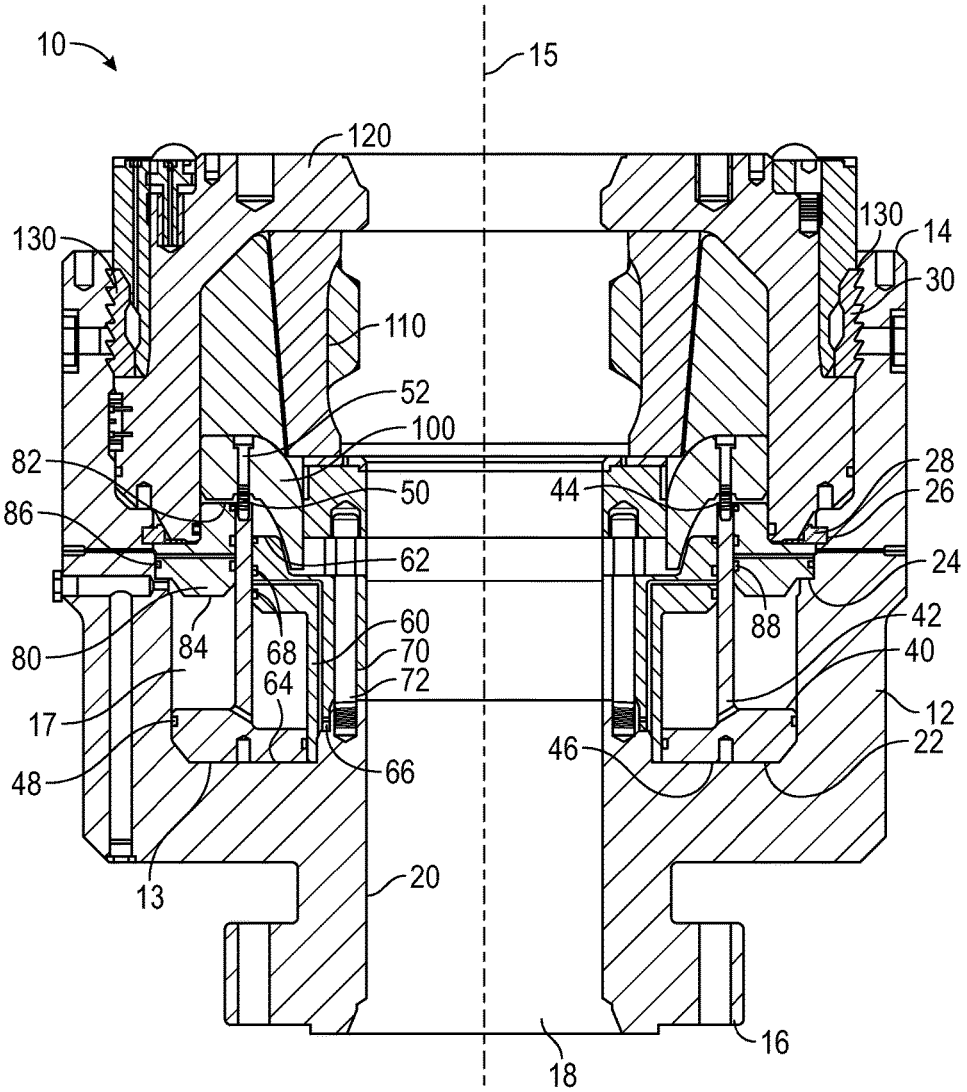
FIG. 1 is a cross-sectional view of an embodiment of an annular BOP in accordance with the principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a cross-sectional view of an embodiment of an annular BOP 10. As discussed above, annular BOPs (including annular BOP 10) may be used in various systems for drilling and/or producing hydrocarbons from a wellbore extending through a subterranean formation. In this embodiment, annular BOP 10 has a central or longitudinal axis 15 and generally includes an outer housing 12, a hydraulic assembly or package 40 disposed within outer housing 12, a sealing assembly 110, an upper hub assembly 120, and an annular lock ring 130 disposed radially between outer housing 12 and upper hub assembly 120. Outer housing 12 of annular BOP 10 has a first or upper end 14, a second or lower end 16, and a central throughbore 18 extending between upper end 14 and lower end 16, where throughbore 18 is defined by an inner surface 20.

As described above, outer housing 12 is generally configured to receive hydraulic package 40, and to couple with upper hub assembly 120 to position and retain seal assembly 110. In this embodiment, the inner surface 20 of throughbore 18 includes an annular seat 22 for receiving a lower end of the hydraulic package 40, where seat 22 faces upper end 14 of outer housing 12, and an annular shoulder 24 longitudinally spaced from seat 22 and facing upper end 14. Inner surface 20 also includes an annular groove 26 extending therein and disposed longitudinally between seat 22 and upper end 14. Annular groove 26 is receives a plurality of locking segments 28 that secure hydraulic package 40 into position once hydraulic package 40 has been seated within outer housing 12 during assembly of annular BOP 10. Thus, locking segments 28 are configured to restrict relative longitudinal movement between hydraulic package 40 and outer housing 12 once hydraulic package 40 has been fully inserted and seated within outer housing 12. The inner surface 20 of outer housing 12 further includes a plurality of annular teeth or engagement members 30 for engaging corresponding teeth or engagement members lock ring 130 to releasably couple upper hub assembly 120 with outer housing 12.

Hydraulic package 40 is configured to actuate sealing assembly 110 between an open position (shown in FIG. 1) allowing for fluid communication through throughbore 18 and a closed position (not shown) restricting fluid communication through throughbore 18. Particularly, in the closed position, the sealing assembly 110 is configured to sealingly engage the outer surface of a tubular member (not shown) extending through throughbore 18 to restrict fluid communication therethrough. In this embodiment, sealing assembly 110 generally includes a plurality of elastomeric members configured to deform upon actuation of hydraulic package 40 and the corresponding engagement therebetween.

In this embodiment, hydraulic package 40 generally includes an annular piston 42, an annular inner cylinder 60, and an annular outer cylinder 80. In certain embodiments, annular piston 42 of package 40 releasably couples with an annular piston plate 100. In this embodiment, piston 42 is disposed radially between inner cylinder 60 and outer cylinder 80, and has a first or upper end 44 and a second or lower end 46. Piston 42 includes an annular seal 48 for sealingly engaging the inner surface 20 of the throughbore 18 of outer housing 12. Piston 42 also includes a threaded aperture 50 extending into upper end 42 for receiving a threaded fastener 52 for releasably coupling piston plate 100 to piston 42, where piston plate 100 is configured to physically engage sealing assembly 110.

Inner cylinder 60 of hydraulic package 40 is disposed radially within piston 42 and has a first or upper end 62 and a second or lower end 64, where lower end 64 seats against seat 22 of outer housing 12 when hydraulic package 40 is fully installed therewithin. Inner cylinder 60 includes an annular seal 66 for sealingly engaging the inner surface 20 of the throughbore 18 of outer housing 12. Inner cylinder 60 includes additional annular seals 68 for sealingly engaging the outer surface of piston 42. Inner cylinder 60 further includes a plurality of circumferentially spaced bores 70 for receiving a corresponding plurality of fasteners or studs 72 for securing inner cylinder 60 to outer housing 12.

Outer cylinder 80 of hydraulic package 40 is disposed radially outwards from piston 42 and has a first or upper end 82 and a second or lower end 84, where lower end 84 seats against annular shoulder 24 of outer housing 12 when hydraulic package 40 is fully installed within outer housing 12. Outer cylinder 80 includes an annular seal 86 for sealingly engaging the inner surface 20 of the throughbore 18 of outer housing 12. Outer cylinder 80 also includes additional annular seals 88 for sealingly engaging the outer surface of piston 42. Upon installation the outer cylinder 80 is secured into position relative outer housing 12 via engagement between outer cylinder 80 and annular shoulder 24 and locking segments 28 seated within annular groove 26.

In this arrangement, inner cylinder 60 and outer cylinder 80 radially position piston 42 within throughbore 18 and sealingly engage piston 42 to provide for the routing of closing and opening fluid flows or pressurizations into throughbore 18. Particularly, in response to pressurizing a closing chamber 13 disposed in throughbore 18, piston 42 is displaced longitudinally upwards until sealing assembly 110 is disposed in the closed position. Conversely, in response to pressurizing an opening chamber 17 disposed in throughbore 18, piston 42 is displaced longitudinally downwards until sealing assembly 110 is disposed in the open position.

Referring to FIGS. 2-6, and embodiment of an assembly tool 200 used in assembling and disassembling annular BOP 10 is shown. Assembly tool 200 is generally configured to install hydraulic package 40 within outer housing 12 of annular BOP 10. Particularly, assembly tool 200 is configured to circumferentially align the components (e.g., piston 42, inner cylinder 60, and outer cylinder 80) of hydraulic package 40, and forcibly seat hydraulic package 40 within outer housing 12 until hydraulic package 40 is fully inserted and installed within outer housing 12. As mentioned above, in order to sealingly engage outer housing 12, the annular seals of hydraulic package 40 are compressed into physical engagement with inner surface 20 of throughbore 18. In this manner, frictional engagement between the annular seals (e.g., annular seals 48, 66, and 86) of hydraulic package 40 and inner surface 20 necessitates the application of force against hydraulic package 40 to fully insert and seal hydraulic package 40 within outer housing 12. As will be discussed further herein, assembly tool 200 is configured to apply the requisite force against hydraulic package 40 to fully insert and seat hydraulic package 40 within outer housing 12. Further, while assembly tool 200 is discussed herein in conjunction with annular BOP 10, in other embodiments, assembly tool 200 may be used to assemble and disassemble other annular BOPs known in the art. Moreover, in still other embodiments, assembly tool 200 may be used to install components of other types of BOPs or oil field equipment known in the art.

In this embodiment, assembly tool 200 generally includes a main plate or hub assembly 202, a plurality of inner seating assemblies 260 coupled to main hub 202, a support ring 300 coupled to main hub 202, a plurality of locking dogs or coupling assemblies 340 coupled to support ring 300, and a plurality of outer seating assemblies 320 coupled to main hub 202 and support ring 300. In certain embodiments, outer seating assemblies 320 comprise first seating assemblies 320 while inner seating assemblies 260 comprise second seating assemblies 260. Main hub 202 releasably couples assembly tool 200 with the hydraulic package 40 of annular BOP 10 while support ring 300 releasably couples assembly tool 200 with outer housing 12. In this arrangement, forces may be applied to both outer housing 12 and hydraulic package 40 via actuation of assembly tool 200. In other words, outer housing 12 may be used by assembly tool 200 for holding assembly tool 200 in position (via physical engagement between outer housing 12 and assembly tool 200) as a seating force is applied to hydraulic package 40 from assembly tool 200.

In this embodiment, main hub 202 has a first or upper end or surface 204, a second or lower end or surface 206, a central throughbore 208 defined by an inner cylindrical surface 210, and an outer cylindrical surface 212, where cylindrical surfaces 210 and 212 each extend between upper end 204 and lower end 206. Main hub 202 includes a plurality of circumferentially spaced pockets 214 that extend into main hub 202 from outer surface 212. Pockets 214 are configured to allow an operator of assembly tool 200 to visually identify the relative longitudinal positions (i.e., positions relative longitudinal axis 15) of hydraulic package 40 and outer housing 12 during the installation of hydraulic package 40 within outer housing 12.

Main hub 202 also includes an annular groove 216 that extends into main hub 202 from lower end 206, where annular groove 216 is configured to receive the upper ends 44, 62, and 82 of piston 42, inner cylinder 62, and outer cylinder 82, respectively. Particularly, annular groove 216 is contoured such that when the upper end of piston 42, inner cylinder 62, and outer cylinder 82 each are disposed directly adjacent or physically engage the lower end 206 of main hub 202, the piston 42, inner cylinder 62, and outer cylinder 82 are placed into longitudinal alignment (i.e., aligned respective longitudinal axis 15) such that each component may be successfully seated within outer housing 12. Specifically, when the components of hydraulic package 40 are in longitudinal alignment, the lower end 64 of inner cylinder 60 is disposed substantially flush with the lower end 46 of piston 46 and the upper end 82 of outer cylinder 80 is disposed proximal the upper end 44 of piston 42. In this arrangement of longitudinal alignment, once hydraulic package 40 has been fully installed and seated within outer housing 12, the lower end 62 of inner cylinder 60 and the lower end 46 of piston 40 are each disposed directly adjacent or physically engage seat 22 of outer housing 12 while outer cylinder 80 is disposed longitudinally beneath annular groove 26 to allow for the installation of locking segments 28, securing outer cylinder 80 into position.

To releasably couple inner cylinder 60 to main hub 202 during installation, main hub 202 includes a plurality of circumferentially spaced threaded fasteners 218 extending between upper end 204 and lower end 206, where fasteners 218 are received within corresponding threaded apertures (not shown) that extend into the upper end 62 of inner cylinder 60. Main hub 202 also includes a plurality of circumferentially spaced apertures 219 for receiving corresponding studs 72 of outer housing 12. To releasably couple outer cylinder 80 to main hub 202 during installation, main hub 202 includes a plurality of circumferentially spaced apertures 220 disposed proximal outer surface 212, where each aperture 220 receives a corresponding threaded fastener 222. In this configuration, each fastener 222 is inserted into a corresponding aperture 90 extending into the upper end 82 of outer cylinder 80, thereby releasably coupling main hub 202 to outer cylinder 80.

Figure 2:
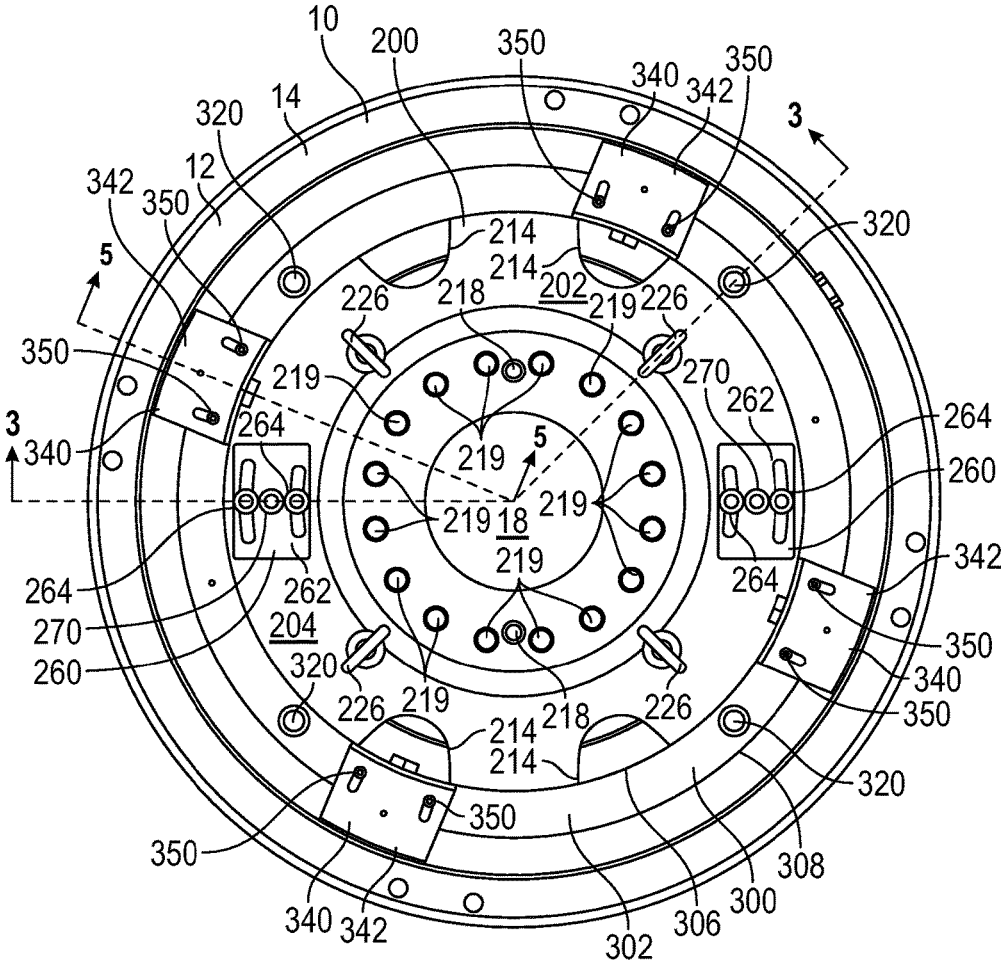
FIG. 2 is a top view of the annular BOP shown in FIG. 1, further including an embodiment of an embodiment of an assembly tool in accordance with the principles disclosed herein.
Figure 3:
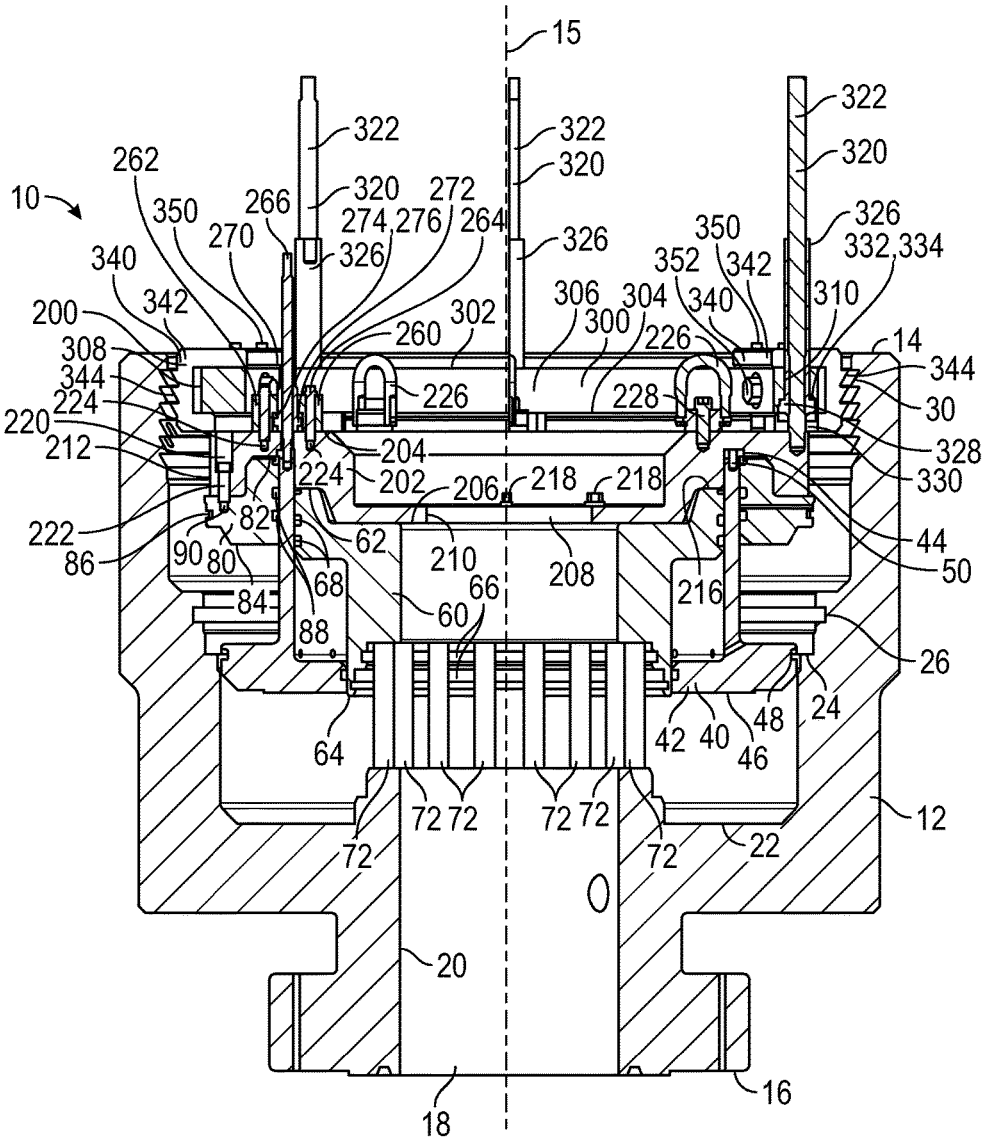
FIG. 3 is a cross-sectional view along lines 3-3 of FIG. 2 of the annular BOP and assembly tool shown in FIG. 2.
Figure 4:
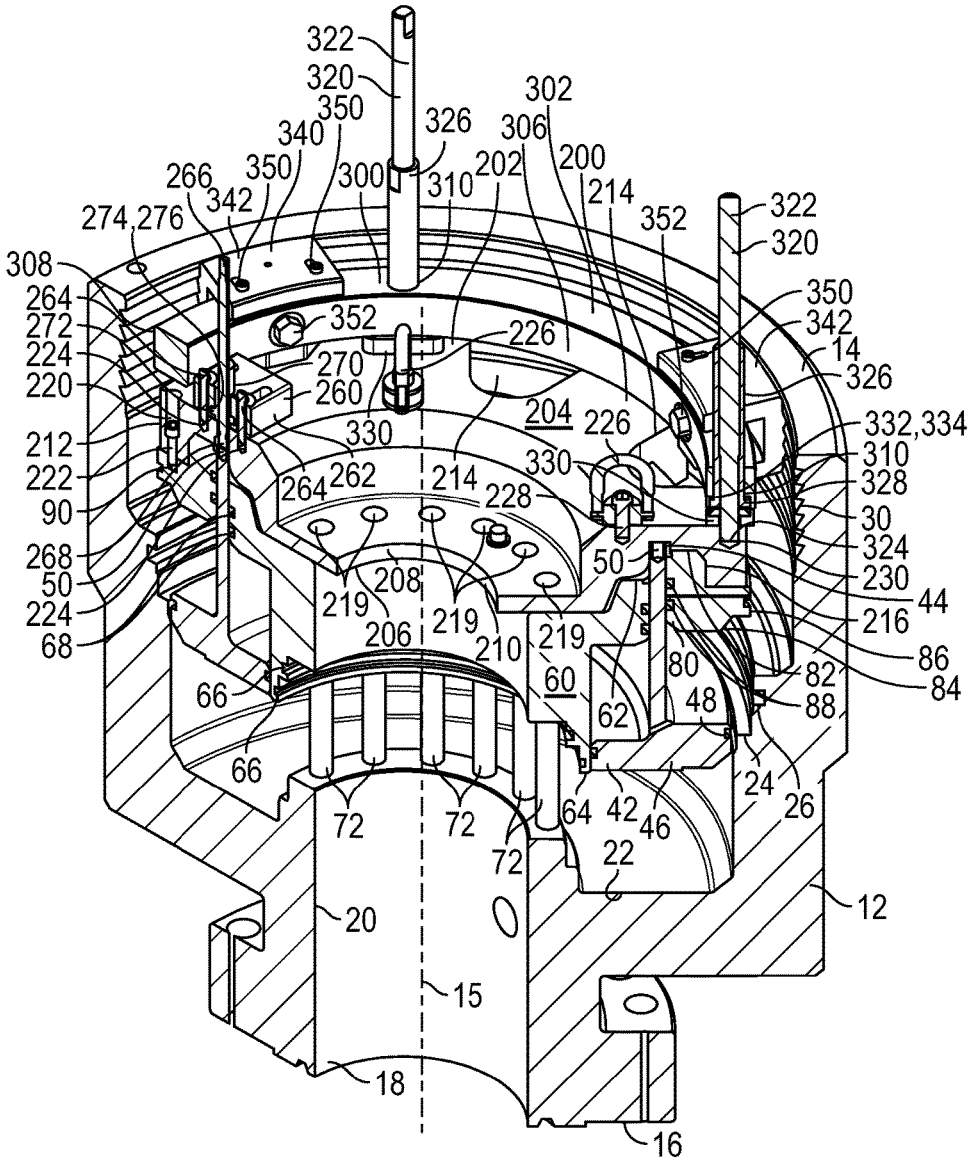
FIG. 4 is a perspective, cross-sectional view along lines 3-3 of FIG. 2 of the annular BOP and assembly tool shown in FIG. 2.
Figure 5:
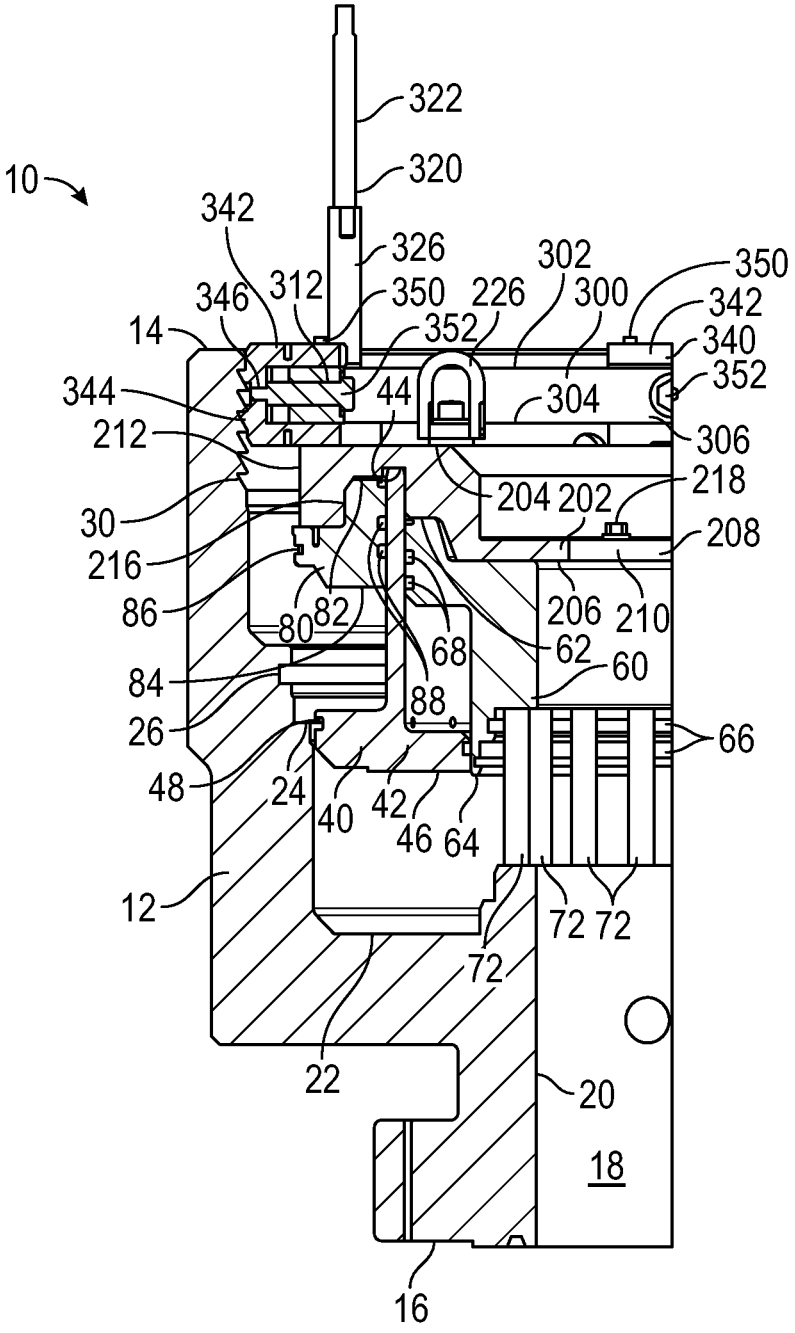
FIG. 5 is a cross-sectional view along lines 5-5 of FIG. 2 of the annular BOP and assembly tool shown in FIG. 2.
Figure 6:
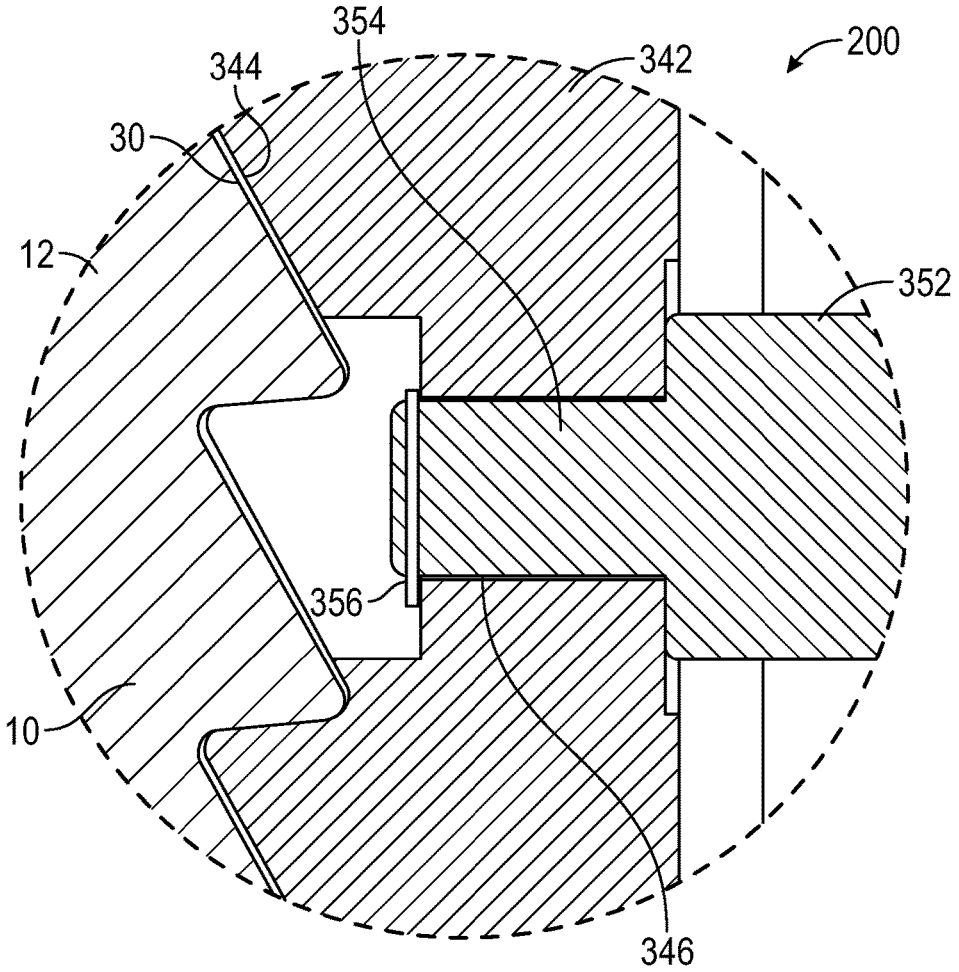
FIG. 6 is a zoomed-in view of an embodiment of a locking dog assembly of the assembly tool shown in FIG. 5 in accordance with the principles disclosed herein.

Compression of seals 68 of inner cylinder 60 and seals 88 of outer cylinder 80 against the outer surface of 42 results in substantial frictional forces imparted to piston 42 when piston 42 is longitudinally aligned with inner cylinder 60 and outer cylinder 80. Frictional forces imparted between piston 42 and cylinders 60 and 80 necessitate using a tensioning or seating assembly to impart a force on piston 42 to successfully longitudinally displace piston 42 relative cylinders 60 and 80 until piston 42 is disposed in longitudinal alignment with cylinders 60 and 80, as shown in FIGS. 2-4. In this embodiment, inner seating assemblies 260 are used to impart the necessary force against piston 42 to successfully longitudinally align piston 42 with inner cylinder 60 and outer cylinder 80.

In this embodiment, each inner seating assembly 260 generally includes a support member or housing 262 releasably secured to main hub 202 via a plurality of threaded fasteners 264 extending through support housing 262 and into corresponding threaded apertures 224 that extend into upper end 204 of main hub 202. Each inner seating assembly 260 also includes a tensioning assembly extending through support housing 262 and including an inner fastener 266 and a displacement sleeve 270 disposed about the inner fastener 266 and configured to longitudinally displace the inner fastener 266 upon rotation of displacement sleeve 270. Inner fastener 266 is externally threaded and has a lower end 268 received within the threaded aperture 50 of piston 42, thereby threadably connecting inner fastener 266 to piston 42.

Displacement sleeve 270 is internally threaded, providing threadable engagement between displacement sleeve 270 and inner fastener 266. In this embodiment, displacement sleeve 270 includes a radially outwards flanged lower end 272 for engaging a lower end of support housing 262, thereby restricting relative longitudinal movement between support housing 262 and displacement sleeve 270. An annular bearing 274 and washer 276 are interposed between flanged lower end 272 of displacement sleeve 270 and the lower end of support housing 262 to allow for relative rotation between displacement sleeve 270 and support housing 262.

In the configuration described above, due to the threadable engagement between displacement sleeve 270 and inner fastener 266, relative rotation between displacement sleeve 270 and inner fastener 266 results in relative longitudinal displacement (i.e., displacement in a direction parallel with longitudinal axis 15) between displacement sleeve 270 and inner fastener 266. In this manner, displacement sleeve 270 may be rotated to displace inner fastener 266 upwards relative main hub 202, thereby displacing piston 42 upwards until upper end 44 of piston 42 is disposed directly adjacent or physically engages the lower end 206 of main hub 202 within annular groove 216. In certain embodiments, displacement sleeve 270 is rotated by hand by an operator of assembly tool 200; however, in other embodiments, displacement sleeve 270 may be rotated via a motor or other mechanism configured to apply a torque.

To assist in manipulating assembly tool 200 and hydraulic package 40 coupled thereto, main hub 202 includes a plurality of circumferentially spaced lifting eyes or ring bolts 226 releasably secured to main hub 202 via a corresponding plurality of fasteners 228 that extend into the upper end 204 of main hub 202. As will be discussed further herein, chains or other flexible members may be coupled to ring bolts 226 and assembly tool 200 and hydraulic package 40 may be suspended from the aforementioned chains during the installation of hydraulic package 40 in outer housing 12.

As described above, support ring 300 of assembly tool 200 is configured to releasably secure or couple assembly tool 200 to the outer housing 12 of annular BOP 10. Particularly, support ring 300 is configured to support main hub 202 by releasably coupling to outer housing 12 via coupling assemblies 340. In this embodiment, support ring 300 is coaxially aligned with main hub 202 and has a first or upper end 302, a second or lower end 304, an inner surface 306, and an outer surface 308, where surfaces 306 and 308 extend between upper end 302 and lower end 304.

Support ring 300 includes a plurality of circumferentially spaced apertures 310, each of which receives a corresponding outer seating assembly 320. In this embodiment, each outer seating assembly 320 includes an inner fastener 322 and a displacement sleeve 326 disposed about the inner fastener 322 and configured to longitudinally displace the inner fastener 322 upon rotation of displacement sleeve 326. Inner fastener 322 is externally threaded and has a lower end 324 received within a corresponding threaded aperture 230 extending into the upper end 204 of main hub 202, thereby threadably connecting inner fastener 322 to main hub 202.

Displacement sleeve 326 is internally threaded, providing threadable engagement between displacement sleeve 326 and inner fastener 322. In this embodiment, displacement sleeve 326 includes a radially outwards flanged lower end 328 for engaging the lower end 304 of support housing support ring. An end cap 330 of outer seating assembly 320 is releasably coupled to the lower end 304 of support ring 300, where flanged lower end 328 of displacement sleeve 326 is disposed between end cap 330 and the lower end 304 of support ring 300. In this arrangement, relative longitudinal movement between support ring 300 and displacement sleeve 326 is restricted. An annular bearing 332 and washer 334 are interposed between flanged lower end 328 of displacement sleeve 326 and the lower end 304 of support ring 300 to allow for relative rotation between displacement sleeve 326 and support ring 300.

In the configuration described above, due to the threadable engagement between displacement sleeve 326 and inner fastener 322, relative rotation between displacement sleeve 326 and inner fastener 322 results in relative longitudinal displacement between displacement sleeve 326 and inner fastener 322. In this manner, displacement sleeve 326 may be rotated to displace inner fastener 322 downwards (e.g., in a longitudinal direction towards lower end 16 of outer housing 12) relative main hub 202, thereby displacing main hub 202 and hydraulic package 40 coupled thereto downwards until the lower end 46 of piston 42 and the lower end 64 of inner cylinder 60 are disposed directly adjacent or physically engage the seat 22 of outer housing 12. In certain embodiments, displacement sleeve 326 is rotated by hand by an operator of assembly tool 200; however, in other embodiments, displacement sleeve 326 may be rotated via a motor or other mechanism configured to apply a torque. The upper end of each inner fastener 322 may also be used to circumferentially align bores 70 of inner cylinder 60 with corresponding studs 72 of outer housing 12 during installation of hydraulic package 40. As will be explained further herein, an operator of assembly tool 200 may apply a force (e.g., by hand) against one or more of inner fasteners 322 to rotate hydraulic package 40 until bores 70 are in circumferential alignment with studs 72.

As described above, coupling assemblies 340 are configured to releasably couple assembly tool 200 to outer housing 12 of annular BOP 10 for installing hydraulic package 40 therein. Coupling assemblies 340 are circumferentially spaced about and coupled with support ring 300. In this embodiment, each coupling assembly 340 generally includes a displaceable locking member or dog 342, a plurality of fasteners 350, and a locking member or rod 352. As shown particularly in FIGS. 5 and 6, locking dog 342 is U-shaped and includes a plurality of teeth or engagement members 344 disposed on an outer surface thereof and an aperture 346 extending therethrough for receiving locking rod 352.

Fasteners 350 of coupling assembly 340 extend through an upper end of locking dog 342 and are received within corresponding apertures (not shown) extending into the upper end 302 of support ring 300 to releasably couple locking dog 342 with support ring 300. Particularly, apertures 350 extend through slots 348 in locking dog 342 that allow for relative radial movement (i.e., movement orthogonal to longitudinal axis 15) between locking dog 342 and support ring 300. Locking rod 352 of each coupling assembly 340 extends through a corresponding radial aperture 312 extending between inner surface 306 and outer surface 308 of support ring 300. As shown particularly in FIG. 6, each locking rod 352 includes a radially outer end 354 having a reduced diameter that extends through aperture 346 of locking dog 342. The radially outer end 354 of locking rod 352 is secured or coupled to locking dog 342 via a snap ring 356 disposed about and coupled to radially outer end 354. In this manner, relative radial movement between locking dog 342 and locking rod 352 is restricted.

The locking dog 342 of each coupling assembly 340 may be selectably actuated between a radially inner or unlocked position (shown in FIG. 3) where teeth 344 are radially spaced from corresponding teeth 30 of outer housing 12, and a radially outer or locked position (shown in FIG. 4) where teeth 344 physically engage teeth 30 of outer housing 12, locking assembly tool 200 to outer housing 12. Specifically, a portion of the outer surface of each locking rod 352 is externally threaded, while each radial aperture 312 of support ring 310 is internally threaded, thereby providing threadable engagement between each locking rod 352 and corresponding radial aperture 312. Thus, rotation of locking rod 352 within radial aperture 312 causes locking rod 352 to be radially displaced respective longitudinal axis 15. Because locking dog 342 is coupled to locking rod 352, radial displacement of locking rod 352 results in radial displacement of locking dog 342 between the locked and unlocked positions. In certain embodiments, locking rods 352 may be rotated by an operator (e.g., using an appropriate tool) of assembly tool 200; however, in other embodiments, locking rods 352 may be rotated by an appropriate actuator configured to provide a torque.

Figure 7:
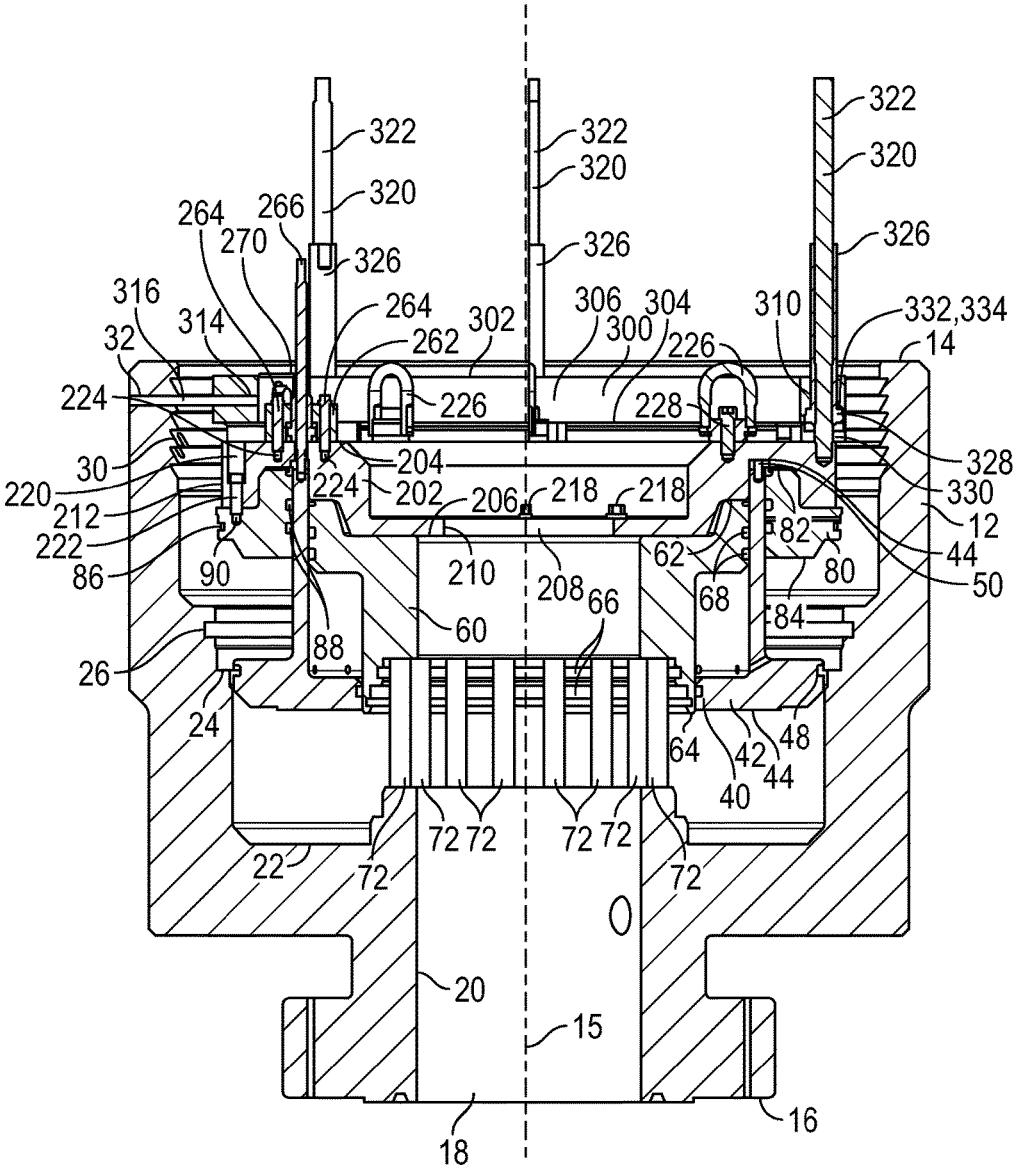
FIG. 7 is a cross-sectional view of another embodiment of an assembly tool in accordance with the principles disclosed herein.

Although assembly tool 200 is illustrated in FIGS. 2-6 as including coupling assemblies 340, in other embodiments, assembly tool 200 may include other mechanisms for releasably coupling support ring 300 to outer housing 12. Referring briefly to FIG. 7, in this embodiment, outer housing 12 includes a plurality of circumferentially spaced apertures 32 and support ring 300 of assembly tool 200 includes a corresponding plurality of circumferentially spaced apertures 314. In this arrangement, a support pin or member 316 is extended through apertures 32 of outer housing 12 and apertures 314 of support ring 300 such that forces may be transferred between support ring 300 and outer housing 12, similar to the functionality provided by coupling assemblies 340.

Figure 8:
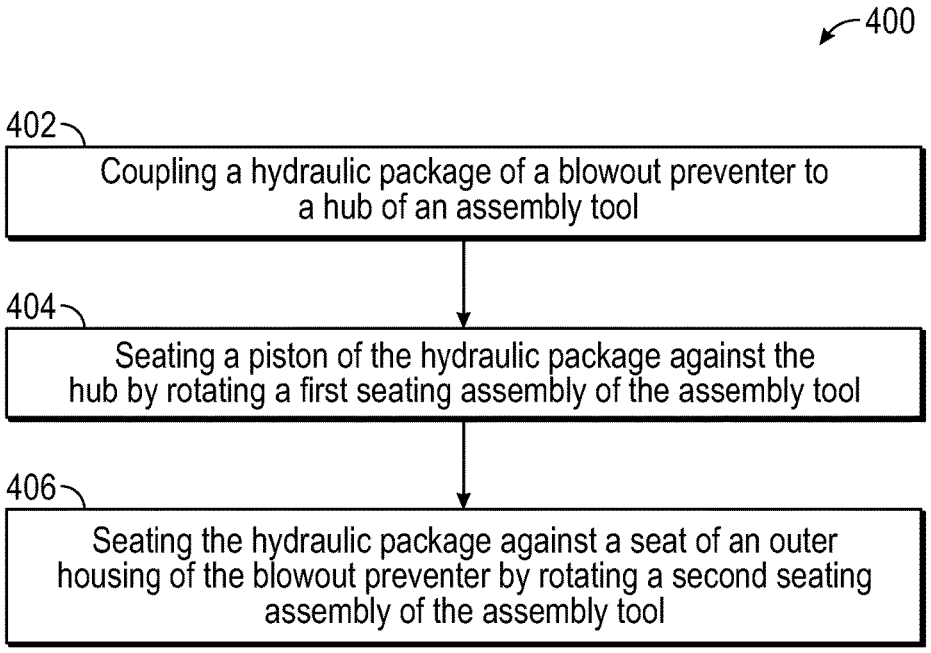
FIG. 8 is a flowchart of an embodiment of a method for assembling a BOP in accordance with the principles disclosed herein.

Referring to FIGS. 2-6 and 8, an embodiment of a method 400 for assembling a BOP is shown in FIG. 8. Beginning at block 402, a hydraulic package of a blowout preventer is coupled to a hub of an assembly tool. In certain embodiments, block 402 comprises coupling main hub 202 to hydraulic package 40 of annular BOP 10. Particularly, block 402 may comprise coupling main hub 202 to outer cylinder 80 via inserting fasteners 222 into apertures 90 of outer cylinder 80, and coupling main hub 202 to inner cylinder 60 by inserting fasteners 218 into corresponding apertures (not shown) of inner cylinder 60. In certain embodiments, block 402 further comprises coupling main hub 202 to piston 42 of hydraulic package 40. Specifically, block 402 may comprise circumferentially aligning piston 42 with main hub 202 such that threaded apertures 50 of piston 42 are circumferentially aligned with inner fasteners 266 of inner seating assemblies 260. Following alignment, inner fasteners 266 are threadably inserted into corresponding apertures 50 to threadably connect piston 42 with inner fasteners 266.

At block 404 of method 400, a piston of the hydraulic package is seated against the hub of the assembly tool by rotating a first seating assembly of the assembly tool. In certain embodiments, block 404 comprises actuating the inner seating assemblies 260 of assembly tool 200 to seat the upper end 44 of piston 42 against the lower surface 206 within annular groove 216 of main hub 202. Particularly, in this embodiment, block 404 comprises rotating the displacement sleeve 270 of each inner seating assembly 260, thereby causing the inner fastener 266 of each inner seating assembly 260 to be displaced longitudinally upwards until the upper end 44 of piston 42 physically engages the lower surface 206 within annular groove 216 of main hub 202.

In this manner, the threadable engagement between displacement sleeves 270 and corresponding inner fasteners 266 imparts sufficient longitudinal force to piston 42 to overcome the frictional engagement between annular seals 68 of inner cylinder 60 and annular seals 88 of outer cylinder 80, each of which frictionally engage or are compressed against the outer surface of piston 42. Further, the seating of piston 42 within annular groove 216 of main hub 202 longitudinally aligns piston 42 with inner cylinder 60 and outer cylinder 80 such that these components of hydraulic package 40 may be successfully installed within outer housing 12 of annular BOP 10.

At block 406 of method 400, the hydraulic package is seated against a seat of an outer housing of the blowout preventer by rotating a second seating assembly of the assembly tool. In certain embodiments, block 406 comprises coupling or securing assembly tool 200 to outer housing 12 of annular BOP 10 via coupling assemblies 340. Particularly, in this embodiment, assembly tool 200 and hydraulic package 40 coupled thereto are lowed into throughbore 18 of outer housing 12 via chains coupled to the ring bolts 226 of assembly tool 200 until coupling assemblies 340 are disposed proximal teeth 30 of outer housing 12. Once assembly tool 200 has been successfully positioned within outer housing 12, the locking rod 352 of each coupling assembly 340 is rotated to actuate the corresponding locking dog 342 from the unlocked position (shown in FIG. 3) to the locked position (shown in FIG. 5) where teeth 344 of each locking dog 342 physically engages corresponding teeth 30 of outer housing 12.

In this arrangement, the weight of assembly tool 200 and hydraulic package 40 is now supported by outer housing 12 via the engagement between coupling assemblies 340 and teeth 30 of outer housing 12. Moreover, force may now be transferred or reacted between outer housing 12 and hydraulic package 40 in order to seat hydraulic package 40 within the throughbore 18 of outer housing 12. In this manner, outer seating assembly 320 and coupling assemblies 340 are configured to apply a force against hydraulic package 40 to seat hydraulic package 40 within throughbore 18 of outer housing 12, and react the force applied to hydraulic package 40 against outer housing 12.

In certain embodiments, block 406 further includes seating the lower end 64 of inner cylinder 60 and the lower end 46 of piston 42 against seat 22 and seating the lower end 84 of outer cylinder 80 against annular shoulder 24 of outer housing 12. Particularly, in this embodiment, block 406 includes rotating the displacement sleeve 326 of each outer seating assembly 320, thereby causing the inner fastener 322 of each outer seating assembly 320 to be displaced longitudinally downwards until the lower end 64 of inner cylinder 60 and the lower end 46 of piston 42 physically engage seat 22 and the lower end 84 of outer cylinder 80 physically engages the annular shoulder 24 of outer housing 12. In this manner, the threadable engagement between displacement sleeves 326 and corresponding inner fasteners 322 imparts sufficient longitudinal force to hydraulic package 40 to overcome the frictional engagement between annular seals 48 of piston 42, the annular seals 66 of inner cylinder 60, and the annular seal 86 of outer cylinder 80, each of which frictionally engage or are compressed against the inner surface 20 of the throughbore 18 of outer housing 12.

Further, the seating of hydraulic package 40 within the throughbore 18 of outer housing 12 longitudinally aligns hydraulic package 40 with outer housing 12 such that annular BOP 10 may be completely assembled for operation. Particularly, the seating of hydraulic package 40 within throughbore 18 aligns outer cylinder 80 such that locking segments 28 may be installed within annular groove 26, thereby securing outer cylinder 80 into position. Moreover, once seated within throughbore 18 of outer housing 12, studs 72 of outer housing 12 extend entirely through corresponding bores 70 of inner cylinder 60. As mentioned above, pockets 214 may be used during the seating of hydraulic package 40 within outer housing 12 to visually determine when hydraulic package 40 has been fully seated. Particularly, a visual determination may be made that outer cylinder 80 has fully cleared annular groove 26, allowing for the installation of locking segments 28.

While method 400 is described above as a method for assembling a BOP, in certain embodiments, method 400 may include additional steps for disassembling a BOP, such as annular BOP 10. Particularly, in certain embodiments, method 400 further includes removing piston plate 100, sealing assembly 110, upper hub assembly 120, and lock ring 130 to expose the remaining components of hydraulic package 40 within outer housing 12. Subsequently, assembly tool 200 is coupled to piston 42, inner cylinder 60, and outer cylinder 80 of hydraulic package 40 in a manner similar to that described with respect to block 402 discussed above. Hydraulic package 40 may then be lifted from outer housing 12 using chains or other flexible members coupled to ring bolts 226 of main hub 202 to remove hydraulic package 40 from the throughbore 18 of outer housing 12.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. An assembly tool for assembling a blowout preventer, comprising:

a hub configured for releasably coupling with a hydraulic package of the blowout preventer;

a support ring coupled to the hub, wherein the support ring is configured for releasably coupling with an outer housing of the blowout preventer;

a first seating assembly coupled to the hub, wherein the first seating assembly is configured to apply a force against the hydraulic package to seat the hydraulic package within the outer housing, and react the force applied to the hydraulic package against the outer housing; and a coupling assembly coupled to the support ring for releasably coupling the support ring to the outer housing, wherein the coupling assembly comprises a locking member configured to actuate the coupling assembly between a radially inner position unlocked from the outer housing and a radially outer position locked to the outer housing via engagement between engagement members of the coupling assembly and corresponding engagement members of the outer housing.

2. The assembly tool of claim 1, wherein the first seating assembly comprises an inner fastener threadably engaging a displacement sleeve disposed about the inner fastener, and wherein the inner fastener is configured to releasably couple with the hydraulic package.

3. The assembly tool of claim 2, wherein, when the inner fastener is coupled to the hydraulic package and the support ring is coupled to the outer housing, rotation of the displacement sleeve causes the inner fastener to be displaced through the displacement sleeve and seat the hydraulic package within the outer housing.

4. The assembly tool of claim 1, wherein the force applied against the hydraulic package reacts against a frictional force applied to the hydraulic package from the outer housing.

5. The assembly tool of claim 1, further comprising a pin inserted through an aperture radially extending through the outer housing and an aperture radially extending through the support ring to releasably couple the support ring to the outer housing.

6. The assembly tool of claim 1, further comprising a second seating assembly coupled to the hub, wherein the second seating assembly comprises an inner fastener threadably engaging a displacement sleeve disposed about the inner fastener, and wherein the inner fastener is configured to releasably couple with a piston of the hydraulic package for seating an upper end of the piston against a lower surface of the hub.

7. An assembly tool for assembling a blowout preventer, comprising:

a hub configured for releasably coupling with a hydraulic package of the blowout preventer;

a support ring coupled to the hub, wherein the support ring is configured to be insertable into an outer housing of the blowout preventer and configured for releasably coupling with an inner surface of the outer housing; and a first seating assembly coupled to the hub, wherein the first seating assembly comprises an inner fastener threadably engaging a displacement sleeve disposed about the inner fastener, and wherein the inner fastener is configured to releasably couple with the hydraulic package;

wherein, when the inner fastener is coupled to the hydraulic package and the support ring is coupled to the outer housing, rotation of the displacement sleeve causes the inner fastener to be displaced through the displacement sleeve and seat the hydraulic package within the outer housing.

8. The assembly tool of claim 7, wherein the first seating assembly is configured to apply a force against the hydraulic package to seat the hydraulic package within the outer housing, and react the force applied to the hydraulic package against the outer housing.

9. The assembly tool of claim 7, further comprising a coupling assembly coupled to the support ring for releasably coupling the support ring to the outer housing, wherein the coupling assembly is actuatable between a radially inner position unlocked from the outer housing and a radially outer position locked to the outer housing via engagement between engagement members of the coupling assembly and corresponding engagement members of the outer housing.

10. The assembly tool of claim 9, wherein the coupling assembly comprises a locking dog comprising the engagement members for engaging the engagement members of the outer housing, and a locking rod threadably engaging the support ring configured for actuating the locking dog between an unlocked position and a locked position.

11. The assembly tool of claim 7, wherein the hub comprises a pocket extending into a radially outer surface of the hub.

12. The assembly tool of claim 7, further comprising a second seating assembly coupled to the hub, wherein the second seating assembly comprises an inner fastener threadably engaging a displacement sleeve disposed about the inner fastener, and wherein the inner fastener is configured to releasably couple with a piston of the hydraulic package for seating an upper end of the piston against a lower surface of the hub.

13. The assembly tool of claim 7, wherein the displacement sleeve of the first seating assembly extends through a support housing of the first seating assembly that is secured to the hub.

* * * * *